United States Patent [19]

Anderson, Jr.

[11] 3,964,613

[45] June 22, 1976

[54] RIFLE SUPPORT

[76] Inventor: William R. Anderson, Jr., 1648 Bethesda Court NE., Atlanta, Ga. 30341

[22] Filed: Jan. 20, 1975

[21] Appl. No.: 542,099

[52] U.S. Cl. ..... 211/64; 312/DIG. 33

[51] Int. Cl.[2] ..... A47F 07/00

[58] Field of Search ..... 312/244, DIG. 33, 4; 211/64

[56] References Cited

UNITED STATES PATENTS

| | | | |
|---|---|---|---|
| 2,946,452 | 7/1960 | Galoievo et al. | 211/64 |
| 3,031,069 | 4/1962 | Hirsch | 211/64 |
| 3,288,304 | 11/1966 | Graves | 211/64 |
| 3,361,265 | 1/1968 | Wemimont | 211/64 |

*Primary Examiner*—Casmir A. Nunberg

*Attorney, Agent, or Firm*—Patrick F. Henry

[57] ABSTRACT

A portable rifle rest with optional storage comprising an elongated storage box having a hinged top, sides and a bottom with the opposed ends of the box each having a cushioned slot therein to support a rifle for cleaning, adjustment and so forth.

7 Claims, 3 Drawing Figures

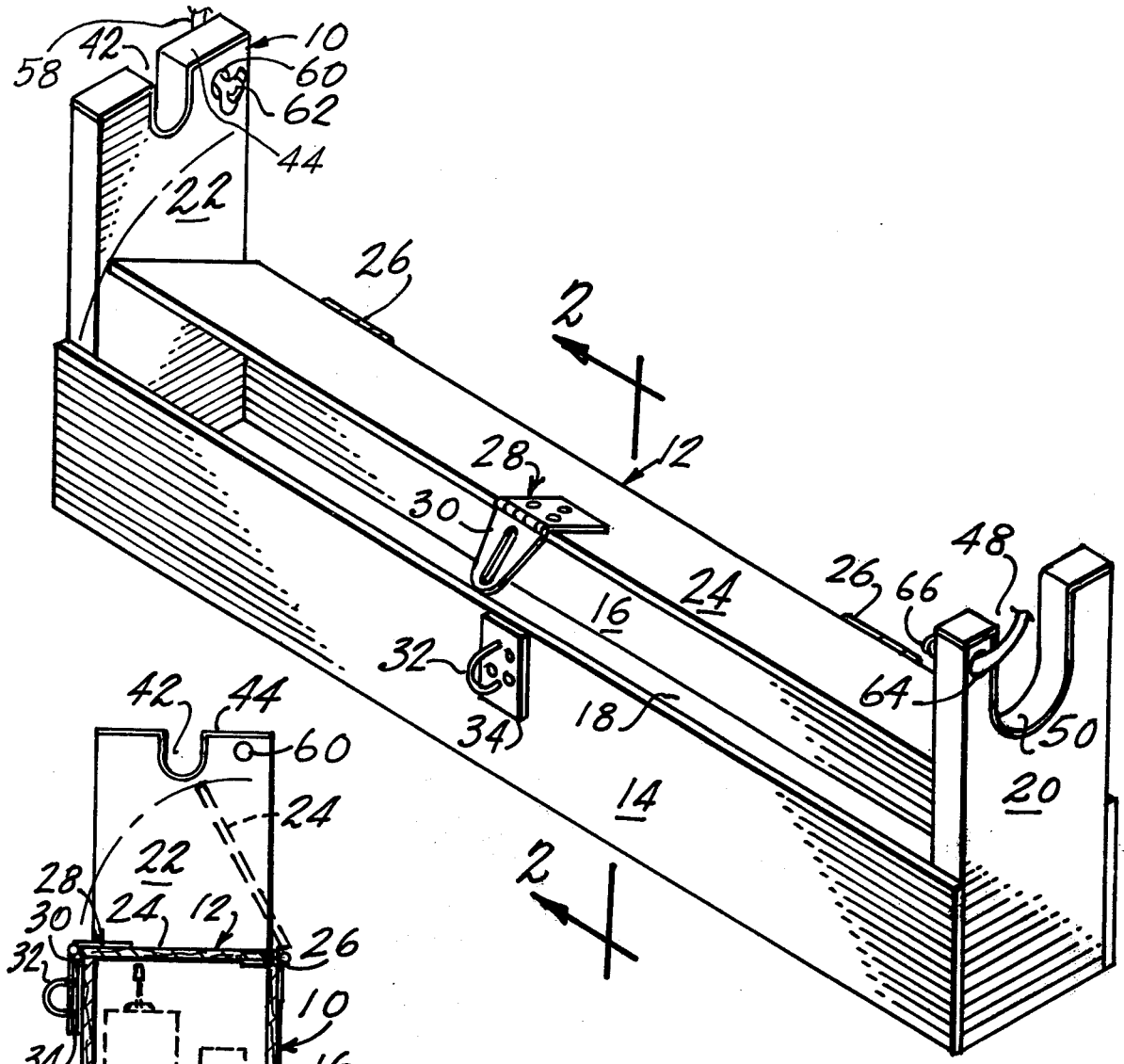
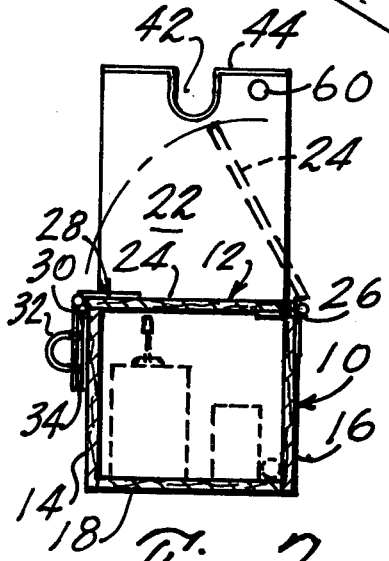
Fig. 2
Fig. 1
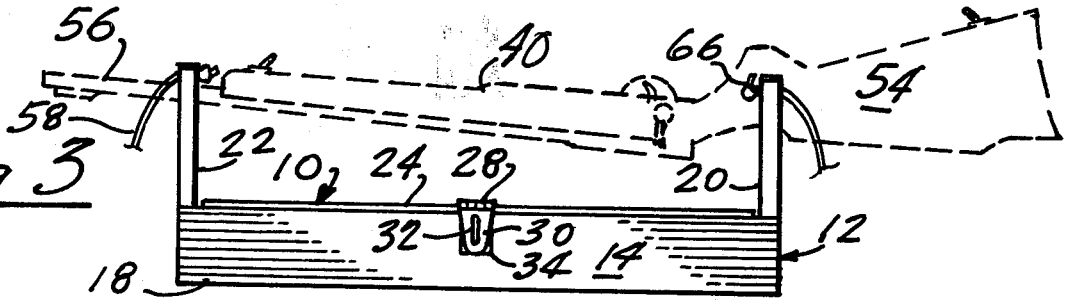
Fig 3

RIFLE SUPPORT

BACKGROUND OF THE INVENTION

1. Field of the Invention

Rifle and firearm supports and storage cabinets.

2. Description of the Prior Art

The prior art includes involved bench devices for supporting firearms and rifles for assembly, disassembly, etc. Heretofore, it has been necessary for someone working on a rifle, particularly out in the field, to rig-up some sort of support for opposite ends of the rifle so that adjustments could be made or simply to support the rifle away from the harmful effects of the ground. In addition, various tools, oil, spare parts and so forth would be carried in a kit or fishing tackle box. This was very inconvenient and awkward for a number of reasons such as the rifle would shift from one position to another and not remain in a substantially fixed position while the work was being performed or else the supports used would fall away and the rifle would drop and so forth. There is therefore a need in the art for a simple and inexpensive rifle support with or without an optional container which can be used in the shop or in the home as well as carried into the field or to the rifle range and the like.

SUMMARY OF THE INVENTION

The present invention provides an inexpensive rifle support which can be used either at home or in the shop or as well in the field or at the rifle range and the like.

Still another object of this invention is to provide a rifle support which includes a small chest or container in which spare parts, oil, tools and the like may be stored.

An additional object of this invention resides in the simplicity of construction which permits the present device to be manufactured from inexpensive pieces of wood which are often found as scrap and excess in wood shops thereby reducing the cost of construction.

Another object of this invention resides in the construction of the device whereby the rifle supports are made from flat pieces of wood with notches cut therein and which also constitute the ends of the storage container.

Other and further objects and advantages of this invention will become apparent upon reading the following description of a preferred embodiment taken in conjunction with the accompanying drawings.

BRIEF DESCRIPTION OF THE DRAWINGS

FIG. 1 is a perspective view of the rifle support and storage container of the present invention.

FIG. 2 is a cross-sectional view taken substantially along lines 2—2 in FIG. 1.

FIG. 3 is a side elevation view of the device shown in FIG. 1 with a rifle shown in position outlined in dotted lines.

DESCRIPTION OF THE PREFERRED EMBODIMENT

The rifle support and storage container is designated generally by reference numeral 10 comprises an elongated box or container designated generally by reference numeral 12 having sides 14, 16, a bottom 18 and opposed ends 20, 22. A top 24 is attached by hinges 26 to sides 16 and closes over the top edge of side 14 to provide a closed container. The top 24 is provided with a hasp 28 including the usual pivoted, slotted tongue 30 which fits over the loop 32 attached by plate 34 to side 14. A lock (not shown) may be placed on the hasp 28. A preferred embodiment has sides 14, 16 that are about 24 inches long and 3 inches wide and ½ inch thick.

Ends 20, 22 constitute the opposed, spaced supports for a rifle which is designated generally by reference numeral 40 as shown in dotted lines in FIG. 3. End 22 has a vertical notch 42 therein which is covered by a thick protective felt 44 which extends over the ends of the top of end 22 as well as down into the notch 42. In similar manner, the end 20 is provided with a longer notch 48 which is covered by a heavy felt 50 that also extends over the upper edge of end 20. It will appear readily from the drawings that the notch 42 is shallower or not as deep as the notch 48 whereby the notch 48 will accommodate the thickness of the stock 54 of the rifle 40 and the notch 42 will accommodate the fore end of the rifle 40 such as supporting the barrel 56. Rifle 40 may be turned over from the position shown in FIG. 3 to place the barrel 56 on top for other work.

A lightweight nylon cord 58 has one end inserted through an opening 60 in end 22 and knotted at 62 and the other end inserted through an opening 64 in end 20 and knotted at 66 to provide a carrying sling which either may be used as a handle or may be worn over the shoulder in the manner of a shoulder bag, camera case and the like.

Top 24, the hardware (hasp 28 etc.) and the bottom 18 may be eliminated and sides 14, 16 reduced in size if no storage is desired thereby making the rifle rest lighter and a little less in cost.

While I have shown and described a particular embodiment of this invention this is for purpose of illustration of a known preferred embodiment and therefore does not constitute any sort of limitation on the scope of the invention since various alterations, changes, deviations, eliminations, substitutions, additions and departures may be made in the embodiment shown without departing from the scope of the invention as defined in the appended claims.

What is claimed is:

1. In a rifle support for a rifle having a stock and a barrel: an elongated base having spaced, opposed rifle supports thereon consisting only of end panels extending substantially vertically upwardly above the top of the base when the bottom of the base is resting on a surface and each of said panels terminating a short distance above the base and having an open top leading into a substantially vertical depression therein for supporting respective ends of a rifle placed with part of the stock of the rifle in one depression and part of the barrel of the rifle in the other depression, the end panel depression having the stock of the rifle therein being shaped to fit the rifle stock snugly and being larger than the other depression thereby to accommodate the stock portion of the rifle snugly in the larger depression whereas the other smaller depression supports the fore end of the rifle barrel so that the rifle extends between the said end panels in a stable elongated position whereby work may be performed thereon without the rifle moving significantly, and means for carrying said rifle support comprising a carrying member attached to said base providing a means for lifting and carrying the entire rifle support from one location to another.

2. The device in claim 1 wherein said base includes a container for oil, spare parts and the like.

3. The device claimed in claim 2 wherein said container has a top closure thereon.

4. The device in claim 3 wherein said container includes elongated sides and a bottom.

5. The device in claim 4 wherein said sides, bottom and top are flat panels made of wood and the like.

6. The device in claim 5 wherein said support ends are panels having the sides attached thereto and extending therebetween.

7. The device in claim 5 wherein said depressions have cushion members, such as heavy felt, thereon.

* * * * *